US005105594A

United States Patent [19]

Kirchner

[11] Patent Number: 5,105,594

[45] Date of Patent: Apr. 21, 1992

[54] HINGED CONNECTOR FOR FLAT DISPLAY PANELS

[75] Inventor: Michael W. Kirchner, Farmington, Minn.

[73] Assignee: Skyline Displays, Inc., Burnsville, Minn.

[21] Appl. No.: 624,998

[22] Filed: Dec. 10, 1990

[51] Int. Cl.[5] ..... H16C 11/00; A47G 5/00

[52] U.S. Cl. ..... 52/239; 160/135; 52/282

[58] Field of Search ..... 52/239, 282, 287, 288; 160/351, 135

[56] References Cited

U.S. PATENT DOCUMENTS

| | | | |
|---|---|---|---|
| 2,210,652 | 8/1940 | Dennett | 160/135 |
| 3,766,959 | 10/1973 | Himsl | 160/351 |
| 4,129,163 | 12/1978 | Johnson | 160/351 |
| 4,263,761 | 4/1981 | Kristoff | 160/351 |
| 4,446,669 | 5/1984 | Siegal | 52/239 |

*Primary Examiner*—David A. Scherbel
*Assistant Examiner*—Joanne C. Downs
*Attorney, Agent, or Firm*—Palmatier & Sjoquist

[57] ABSTRACT

A fabric-covered hinged connector for flat display panels with fabric exteriors. The hinged connector includes caps formed of semi-rigid PVC and having opposing channel portions and tapered ends which are integrally connected with an elongate hinge formed of flexible PVC. The exterior surface and a large portion of the interior surface of the hinge connector are overlaid with fabric. A display panel is inserted into each of the channel portions. The paired display panels may thus be oriented at numerous angles relative to each other while the hinge connector itself is concealed by the fabric. The semi-rigid caps and flexible hinge piece are integrally formed simultaneously in one extrusion process.

6 Claims, 2 Drawing Sheets

HINGED CONNECTOR FOR FLAT DISPLAY PANELS

The present invention relates to hinged connectors for interconnecting flat display panels and, more particularly, to flexible hinged connectors.

BACKGROUND OF THE INVENTION

A pleasing aesthetic appearance of a trade show booth is important in the presentation of a product or service on the floor of a distracting, noisy convention. If a trade show booth creates a distinct, warm environment, customers are not only more likely to be drawn into the booth, but also are more apt to listen to a pitch of an exhibitor.

A number of factors may contribute toward a pleasing trade show booth. One factor is typically the creation of a solid continuous backdrop to set apart the booth's space from neighboring booths and to provide simple, nondistracting means for displaying signs, logos and other advertising material such as posters. Such a backdrop may also create the impression of greater space. Moreover, it is desirable that a solid continuous backdrop be disposable in a zigzag fashion to create different floor plans or sub-booths for display of different products.

SUMMARY OF THE INVENTION

A feature of the present invention is the provision in a hinged connector for hingedly connecting flat display panels, of a pair of elongate opposing caps with channels for receiving side edges of the display panels and with a flexible hinge connection therebetween for disposing the flat display panels at different angles relative to each other.

Another feature is the provision in such a hinged connector, of an elongate flange integral with the caps and extending transversely into the channels for abutting and aligning the display panels.

Another feature is the provision in such a hinged connector, of an elongate piece of fabric overlaying the caps and flexible hinge connection such that the hinged connector resembles the fabric exterior of the flat display panels and provides the appearance of a solid, smooth transition from one display panel to an adjacent display panel.

An advantage of the present invention is that it provides the appearance of a solid, continuous transition between adjacent flat display panels.

Another advantage is that the hinged connector is inconspicuous. Its fabric covering blends in with the adjacent flat display panel. Hence, a customer's attention is drawn to the product or service presented, not to the trade show booth itself.

Another advantage is that a plurality of flat display panels may be interconnected to provide a variety of floor plans.

Another advantage is that the hinged connector allows two or more adjacent flat display panels to be self-supporting after being joined.

Another advantage is that a trade show booth is easily and quickly assembled and disassembled with the hinged connector.

Another advantage is that the hinged connector is inexpensive and simple to manufacture.

DETAILED DESCRIPTION OF THE PREFERRED EMBODIMENT

Figure 1:
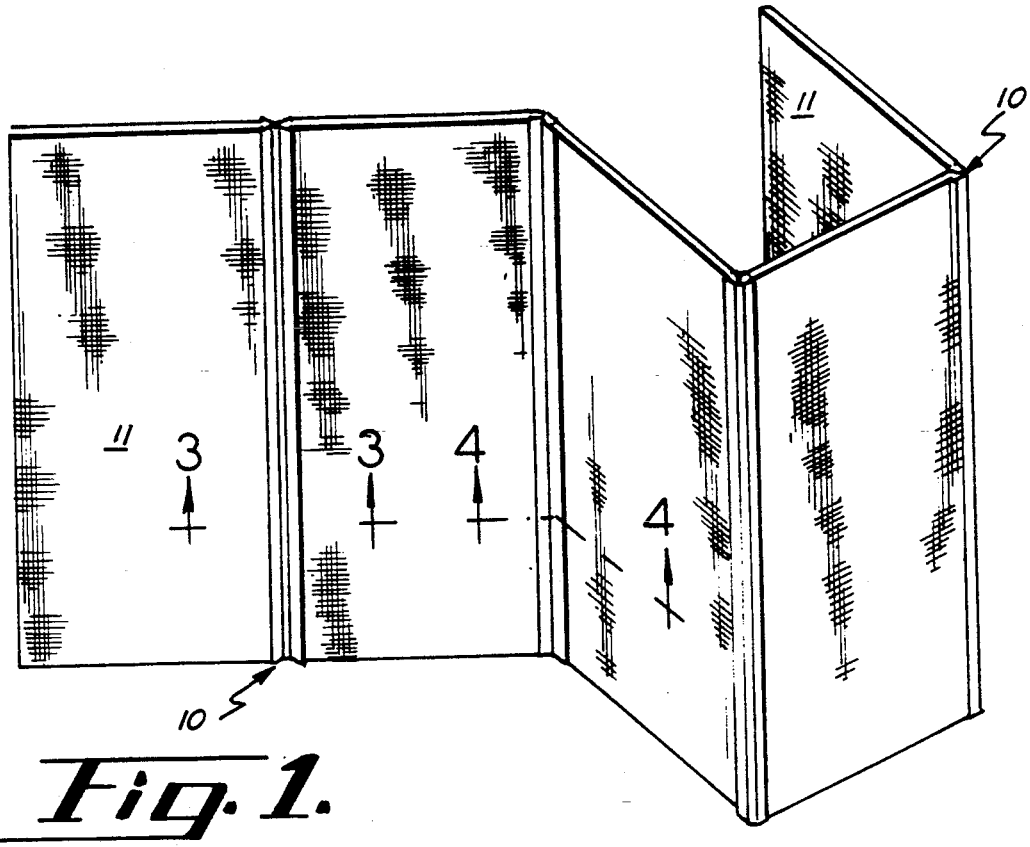
FIG. 1 is a perspective view of a set of five flat display panels joined by four hinged connectors.

As shown in FIG. 1, the present hinged connector is indicated in general by the reference numeral 10. The hinged connector 10 is elongate and is disposed vertically when joining adjacent flat display panels 11. Such panels 11 may be fabric covered foamboard or cardboard or be formed of any material which is light and rigid or semi-rigid.

Figure 2:
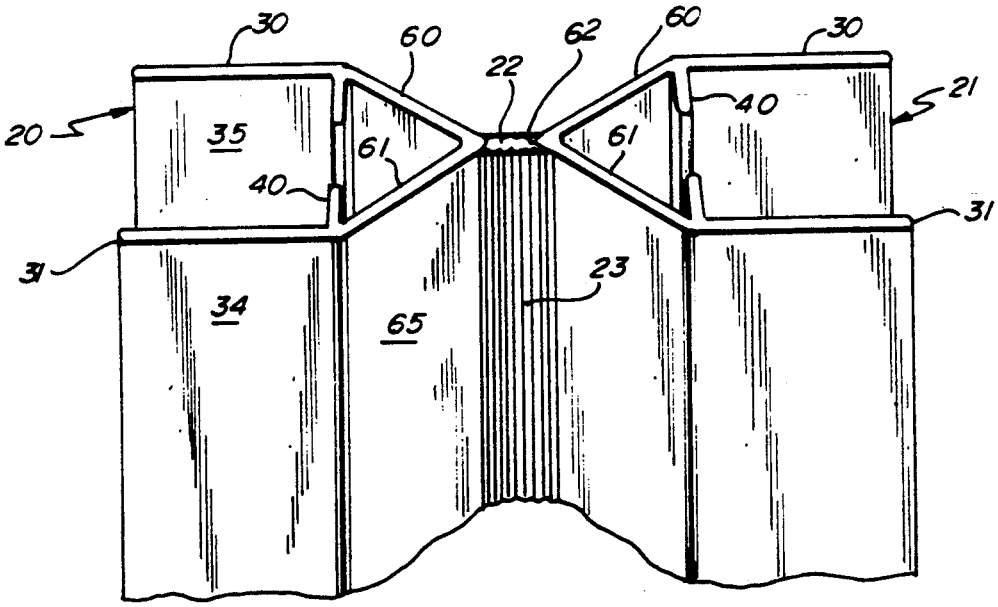
FIG. 2 is a perspective view of an elongate portion of the hinged connector absent the overlaying fabric.
Figure 3:
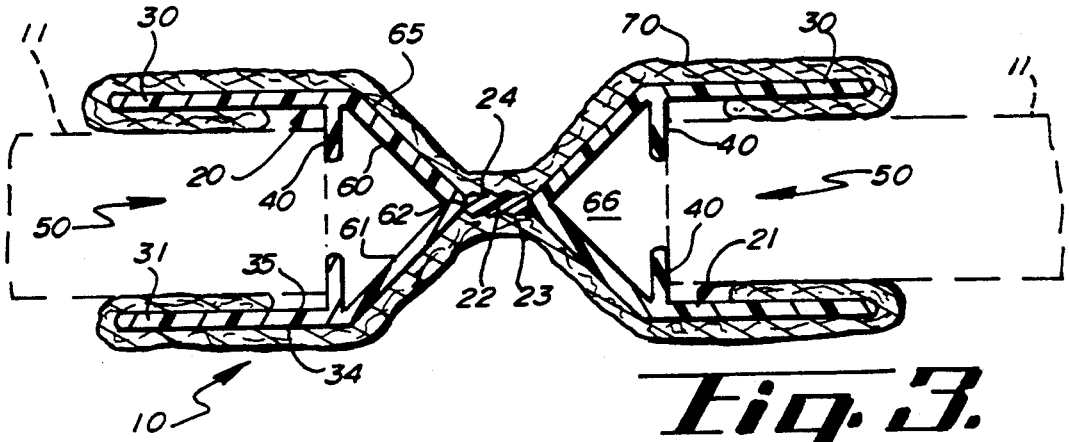
FIG. 3 is a section view of the hinged connector with the caps disposed in line with each other.

As shown in FIGS. 2 and 3, the hinged connector 10 includes a pair of opposing resilient caps 20, 21. The caps 20, 21 are identical, although joined in a mirror fashion relative to each other. The caps 20, 21 are typically formed of a rigid or semi-rigid PVC. A flexible hinge connection 22 integrally joins the caps 20, 21 and is typically formed of a flexible PVC. The flexible hinge connection includes opposing exterior surfaces 23, 24. The caps 20, 21 and flexible hinge connection 22 are integrally formed simultaneously in one extrusion.

More particularly, each of the caps 20, 21 forms generally the shape of an arrowhead and includes a pair of elongate resilient sidewalls 30, 31 which run parallel to each other. Each of the sidewalls 30, 31 includes respective exterior and interior surfaces 34, 35. The caps 20, 21 are inwardly biased to grip the side edges of the display panels 11.

An abutment elongate resilient flange 40 for abutting a side portion of the flat display panel 11 extends integrally inwardly and transversely. The flanges 40 of each of the caps 20, 21 lie in a common plane and extend at right angles from their respective sidewalls 30, 31.

The sidewalls 30, 31 and the abutment flanges 40 of each of the caps 20, 21 form an elongate channel 50 for receiving a side portion of one of the flat display panels 11. A panel 11 is insertable into each of the channels 50 until it is brought to bear against the abutment flanges 40 whereupon the panel 11 is frictionally secured in one of the respective caps 20, 21 between resilient sidewalls 30, 31.

A pair of elongate, resilient closed end walls 60, 61 converge inwardly toward each other from respective sidewalls 30, 31 to form an apex 62. Each of the pairs of end walls 60, 61 form a right angle. The flexible hinge connection 22 is integrally joined between the apices 62 of the respective caps 20, 21.

Each of the end walls 60, 61 further includes an exterior surface 65 and a triangular interior space 66 formed partially by the abutment flanges 40. Each of the spaces 66 communicates with its respective channel 50.

An elongate piece of fabric covering 70 is affixed entirely over the exterior surfaces 65 of the end walls 60, 61, exterior surfaces 34 of the sidewalls 30, 31 and over at least one-half of each of the interior surfaces 35 of the sidewalls 30, 31. The fabric covering 70 is typically not fixed to the opposing surfaces 23, 24 of the flexible connection 22 to provide a free flexing of the flexible connection 22, although some types of fabric coverings may be so affixed to the surfaces 23, 24.

The fabric covering 70 is wrapped about the outer edges 32 of the sidewalls 30, 31 to extend at least one-half of the distance along the interior surfaces 35 to the flanges 42. The width dimensions of the sidewalls 30, 31 and fabric covering 70 are relatively small compared to the thickness of the panels 11. Accordingly, when the fabric covering 70 matches the fabric of the panels 11, the hinged connector 10 blends in with the panels 11 with any transitional lines being almost indistinguishable, although such lines are shown in FIG. 1. It should be noted that the fabric covering 70 also is affixed to and conceals the extreme upper and lower edges of the hinged connector 10.

Figure 4:
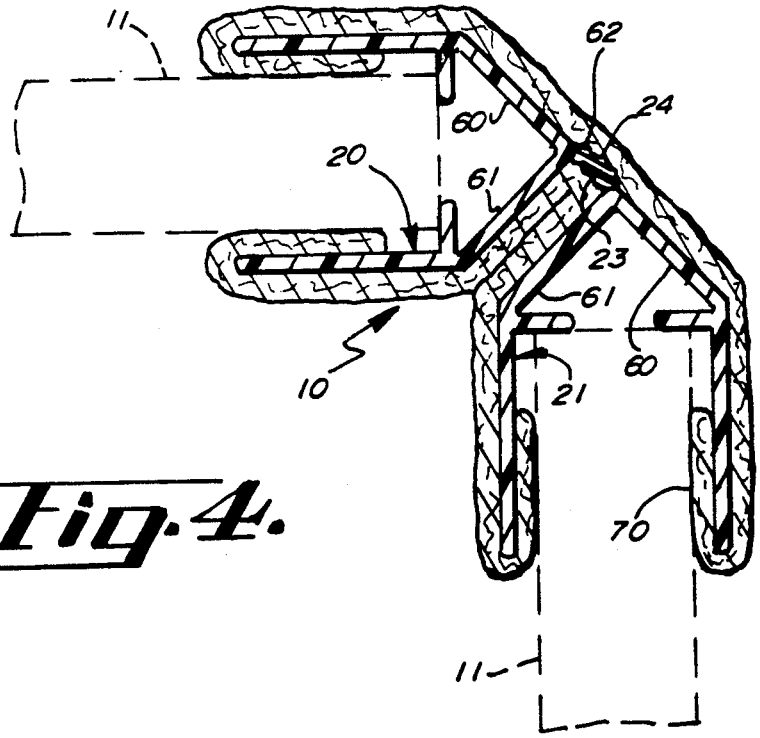
FIG. 4 is a section view of the hinged connector with the caps disposed at a right angle relative to each other.

As shown in FIG. 4, the caps 20, 21 are swingable to be disposed at right angles relative to each other. In other words, a central axis of each of the channels 50 of the caps 20, 21 may be disposed at a right angle relative to the other central axis of the other channel 50. When the caps 20, 21 are disposed at a right angle to each other, end walls 60 are oriented in line with each other and end walls 61 confront and run parallel to each other. Each of the caps 20, 21 are swingable through at least 180° arcs relative to each other such that end walls 60 confront each other and end walls 61 are oriented in line with each other.

In operation, a single flat display panel 11 is lifted upright and one of the caps 20, 21 of the hinge connector 10 is slipped onto a vertical side portion of the panel 11. As the panel 11 slides into the channel 50, the sidewalls 30, 31 may resiliently bend apart to frictionally secure the panel 11 in the hinged connector 10. The panel 11 is fully engaged between the sidewalls 30, 31 when the flanges 40 bear against the side edge of the panel 11. Subsequently, a second panel 11 is inserted into the free caps 20 or 21. When the panels 11 are engaged with the hinged connector 10, the hinged connector 10 or panels 11 may be slid vertically such that the top and bottom edges of the panels 11 and hinged connector 10 are flush.

Subsequently, to create the desired floor plan, the panels 11 are simply swung toward or away from each other to swing the caps 20, 21 relative to each other and to bend the flexible hinge connection 22. When the caps 20, 21 are bent at a right angle, the flexible hinge connection 22 exerts little or no force on the orientation of the caps 20, 21; little stress or strain exists in the flexible hinge connection 22 when bent as such.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A hinged connector formed of a single continuous plastic extrusion, for hingedly connecting flat display panels with side edges, comprising:

a) a pair of elongate opposing caps, each of the caps comprising an elongate open end with a channel and a closed elongate end with a pair of converging end walls, each of the channels receiving one side edge of one of the flat display panels;

b) an elongate abutment flange integral with the caps and extending transversely into the channels for abutting and aligning the display panels; and c) flexible hinge connection means running integrally between the closed elongate ends for flexibly orienting the elongate opposing caps and display panels relative to each other such that each of the display panels is swingable through the at least 180° relative to each other.

2. The hinged connector according to claim 1, further comprising an elongate piece of fabric overlaying the caps and flexible hinge connection means and extending at least partially into the channels to provide the appearance of a smooth transition from one display panel to an adjacent display panel.

3. The hinged connector according to claim 1, wherein the converging walls of each of the caps taper to form an apex, the flexible connection means secured between the apices.

4. The hinged connector according to claim 1, wherein the two converging end walls are joined at a right angle, such that when the caps are disposed at a right angle to each other one of the end walls of one of the caps lies parallel to one of the end walls of the other cap and the other end walls of the caps lie in line with each other.

5. The hinged connector according to claim 1, wherein each of the caps includes a pair of elongate sidewalls running parallel to each other and defining its respective channel, each of the sidewalls being resilient and having an inward bias to grip its respective display panel.

6. A hinged connector formed of a single continuous plastic extrusion for hingedly connecting at least two flat display panels with sides edges and fabric exteriors, comprising:

a) a pair of elongate opposing caps, each of the caps comprising an elongate channel, a closed elongate end, and an elongate exterior surface, each of the elongate channels being formed by a pair of elongate flat sidewalls extending integrally from the closed elongate end and running parallel to each other and having respective interior surfaces, each of the closed elongate ends having flat end walls which are joined at a right angle to form an apex, each of the caps being resilient and having an inward bias to grip one of the side edges of one of the display panels;

b) an elongate abutment flange extending integrally from each of the sidewalls into each of the channels for abutting the display panels, the flanges of each of the respective caps being planar with each other and spaced from each other, each of the flanges being disposed adjacent to its respective closed elongate end and at a right angle relative to its respective channel;

c) an elongate flexible hinge connection secured between and integral with the apices for flexibly orienting the caps and display panels relative to each other such that each of the caps is swingable through at least a 180° arc relative to each other and such that when the caps are disposed at a right angle to each other one of the end walls of one of the caps lies parallel to one of the end walls of the other cap and the other end walls of the caps lie in line with each other, the flexible hinge connection having an exterior surface, the caps and flexible hinge connection means being integrally formed simultaneously in one extrusion; and d) an elongate piece of fabric overlaying the exterior surfaces of the caps and flexible hinge connection and extending across at least one-half of the interior surfaces of the sidewalls such that the hinged connector resembles the fabric exteriors of the flat display panels and provides a solid, smooth transition from one display panel to an adjacent display panel.

* * * * *